United States Patent [19]

VanTielen

[11] 4,295,317

[45] Oct. 20, 1981

[54] MODULAR TOWER AND METHOD OF CONSTRUCTING SAME

[76] Inventor: Willem R. VanTielen, Rte. No. 3, Box 17, East Jordan, Mich. 49727

[21] Appl. No.: 48,482

[22] Filed: Jun. 14, 1979

[51] Int. Cl.[3] ..... E04H 12/00

[52] U.S. Cl. ..... 52/637; 52/654

[58] Field of Search ..... 52/637, 638, 654, 648; 405/227

[56] References Cited

U.S. PATENT DOCUMENTS

| | | | |
|---|---|---|---|
| 311,165 | 1/1885 | Adams | 52/638 |
| 1,853,086 | 4/1932 | Scannell | 52/638 |
| 2,387,120 | 10/1945 | Cohen | 52/638 X |
| 2,857,026 | 10/1958 | Jones | 52/637 |
| 3,360,288 | 12/1967 | Holscher | 52/654 |
| 3,388,511 | 6/1968 | Davidson et al. | 52/638 |
| 3,485,005 | 12/1969 | Kutchai | 52/638 |
| 3,724,222 | 4/1973 | Crain | 405/227 |
| 3,791,154 | 2/1974 | Crain | 52/654 X |
| 4,098,090 | 7/1978 | Dotti | 52/654 |

*Primary Examiner*—J. Karl Bell

*Attorney, Agent, or Firm*—Michael L. Bauchan

[57] ABSTRACT

A modular tower and method of constructing same is provided in which successive tower sections are joined. Each tower section is comprised of several tubular columns. Certain column ends are crimped for insertion into other columns. A brace assembly having tubes which substantially encircle the columns in each tower section is provided, the tubes being positioned to encircle the column where the crimped section of one column is inserted into another column. The columns are rigidly secured together by bolting the brace assembly to each of the columns encircled by each brace tube. A mast support brace assembly is provided for supporting a mast which extends from the tower top. A mast guide brace is provided for connecting the top of the uppermost columns and guiding a mast supported by the tower.

6 Claims, 11 Drawing Figures

MODULAR TOWER AND METHOD OF CONSTRUCTING SAME

This invention relates to a modular tower and a method of constructing same.

Modular towers of various configurations have previously been developed. For example, Hughes et al U.S. Pat. No. 1,174,501 describes a pole construction and Holscher U.S. Pat. No. 3,360,288 describes a joint for modular tower. Crain U.S. Pat. No. 3,724,222 describes a mooring structure end method of erecting such structure. In addition, various television antenna towers are in common usage in which the tower is comprised of a series of sections stacked on top of each other.

Each of the aforementioned structures appear to have been designed for a specific purpose and may satisfactorily have fulfilled the intended purpose. However, such structures are not of such a nature that a single individual with minimal experience in tower construction could erect a modular tower.

It is therefore an object of this to provide a modular tower comprising discrete tower sections which may be easily stacked on each other so that a single individual can erect a tower.

It is a further object of this invention to provide a modular tower in which axial loads in each tower section column are transmitted directly to columns supporting said section.

It is another object of this invention to provide a modular tower in which each member may be removed from each other member so as to be packaged in minimal volume when the tower is disassembled.

It is a further object of this invention to provide a modular tower in which braces used to connect vertical columns may be fabricated from a single casting to expedite manufacturing of same.

It is a further object of this invention to provide a modular tower having a mast support brace which both supports vertical columns and also supports a mast centrally located between the vertical columns.

It is a further object of this invention to provide a modular tower which incorporates a mast guide brace that both supports vertical columns and also guides a mast centrally located between said columns.

It is yet another object of this invention to provide a modular tower having lightweight but strong braces connecting vertical columns and which provide a foot support for climbing the tower.

It is yet another object of this invention to provide a method of erecting a modular tower in which a single person can build the tower.

The foregoing objects and advantages of the subject invention will be apparent from the accompanying description and drawings, in which.

DESCRIPTION OF THE PREFERRED EMBODIMENT

Figure 1:
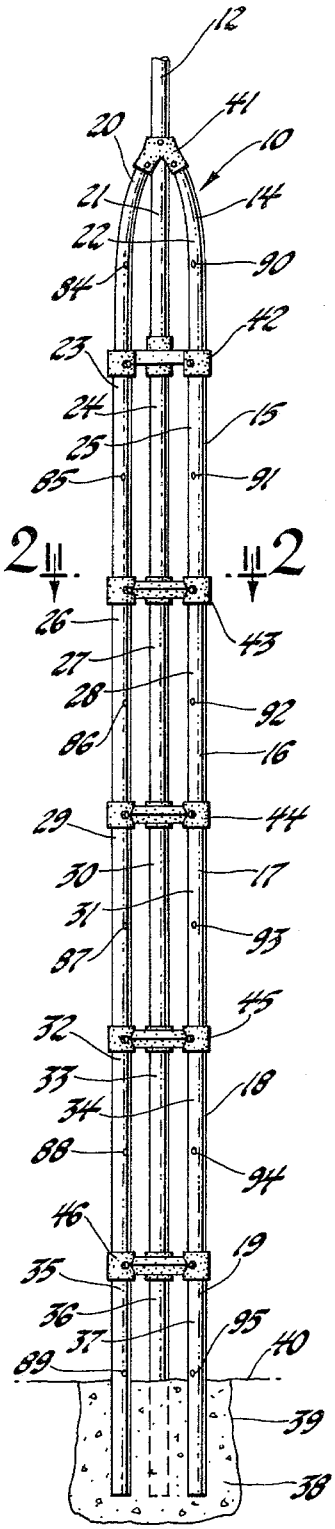
FIG. 1 is perspective view of a modular tower embodying the principles of the subject invention.

Refering now to the drawings, a modular tower 10 embodying the principles of the subject invention is illustrated in FIG. 1. In the embodiment illustrated in FIG. 1, the modular tower 10 supports a cylindrical mast 12. The modular tower 10 includes a mast support section 14 and a series of base sections 15–19 which are substantially identical.

The mast support section 14 includes three substantially vertical columns 20–22 which each contain holes as indicated for reasons which will later become apparent. The base sections 15–19 each contains substantially vertical columns 23–37 which each also contain holes as illustrated for purposes which will later be discovered.

In the illustrated embodiment, columns 35–37 of base section 19 are embedded in concrete 38 put in a hole 39 in the ground 40.

In the preferred embodiment illustrated in FIG. 1, all of the columns 20–37 are tubular and for maximum strength with reasonable weight and cost may be manufactured from aluminum.

The top ends of columns 20–22 in FIG. 1 are secured by a mast guide brace assembly 41. In FIG. 1 the mast support section 14 is connected to base section 15 by a mast support brace assembly 42. The base sections 15–19 are connected by junction brace assemblies 43–46 which are each identical.

Figure 2:
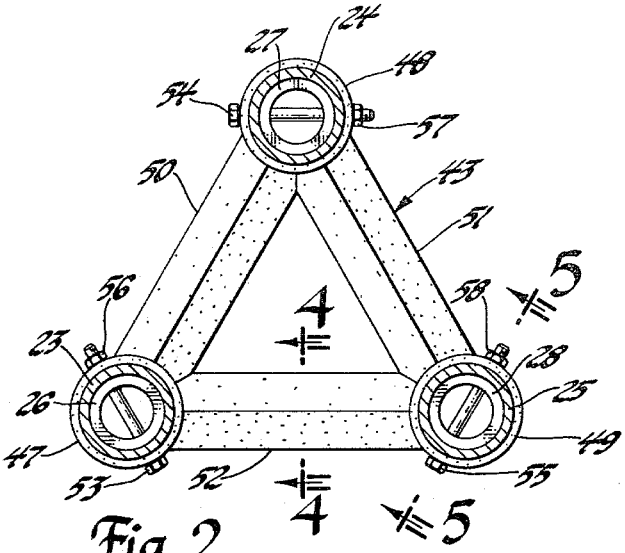
FIG. 2 is an enlarged sectional view taken on lines 2—2 in FIG. 1 showing a perspective view of a junction brace assembly.

The junction brace assembly 43 is illustrated in FIG. 2 and includes cylindrical tubes 47–49 which are defined by a diameter slightly larger than the diameter of the columns 23–25 and by a vertical axis. The tubes 47–49 are connected by rigid support members 50–52. In the illustrated embodiment the upper end of each column 23–37 is crimped so that the upper end of each column may be inserted into the lower end of the column on top of it. Holes are provided in the middle and upper end of each column so that mast guide brace assembly 41, mast support brace assembly 42, and junction brace assemblies 43–46 may be securely bolted to the columns 20–37. As shown in FIG. 2, bolts 53–55 and nuts 56–58 are provided for rigidly connecting the junction brace tubes 47–49 to the columns 23–28.

Figure 3:
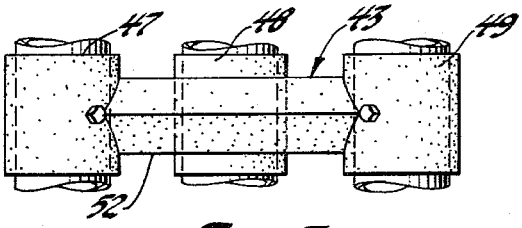
FIG. 3 is a plan view of the junction brace assembly of FIG. 2.
Figure 4:
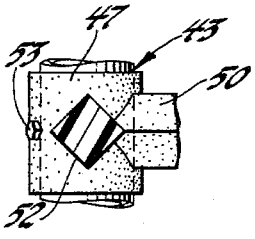
FIG. 4 is a sectional view taken on lines 4—4 in FIG. 2.

As shown in FIGS. 3 and 4, the support members 50–52 in junction brace assembly 43 may be manufactured to have a square cross section.

Figure 5:
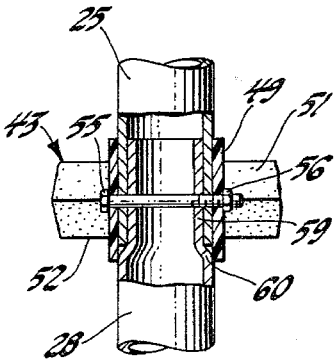
FIG. 5 is a sectional view taken on lines 5—5 of the brace assembly in FIG. 2.

Each of the junctions between the respective columns 20–37 are made in an identical manner illustrated in FIG. 5. As shown in FIG. 5, column 28 in its middle and lower sections is a cylindrical tube defined by a certain outside diameter and a certain inside diameter. The inside and outside diameters of column 28 are identical with the inside and outside diameter of column 25. However, the upper end of column 28 contains a crimped section 59 defined by an outside diameter slightly smaller than the inside diameter of column 25 to facillitate insertion of the upper end of column 28 into the lower end of column 25. An annular shoulder 60 is formed at the point where the column 28 is crimped. Accordingly, when the crimped section of column 28 is inserted in the lower end of column 25, the lower end of column 25 is supported by the annular shoulder 60 and axial forces in column 25 are uniformly transmitted through shoulder 60 into column 28.

The junction brace assembly 43 is positioned so the junction brace tube 49 encircles the columns 25 and 28 at the point where they join. The tube 49 in the preferred embodiment illustrated has an axial length which extends from around the shoulder 60 to the end of column 28 so the entire section at which the columns 25 and 28 overlap is surrounded and supported by the tube 49. The tube 49 thus strengthens the junction between the columns 25 and 28.

Figure 6:
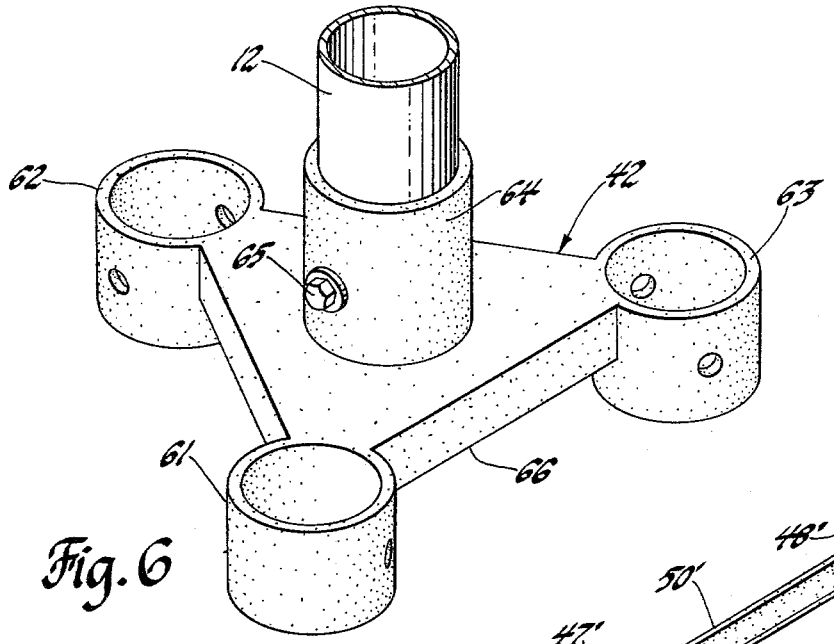
FIG. 6 is a perspective view of a mast support brace assembly shown in FIG. 1.

The mast support brace assembly 42 is illustrated in FIG. 6 and includes tubes 61–63 which have the same inside diameter and holes therein as the tubes 47–49 of the junction brace assembly 43. The mast support assembly 42 also includes a mast support tube 64 which has a vertical axis on which the mast 12 is inserted and held in place by bolt 65. The mast support brace assembly 42 includes a solid plate 66 which rigidly connects the tubes 61 through 63 and the mast support tube 64. In the preferred embodiment illustrated, the mast 12 is inserted in the mast support tube 64 until the mast 12 contacts the solid plate 66 so as to support the weight of the mast 12 on the plate 66. If a TV antenna or other similar structure is mounted on top of the mast 12, which would be in keeping with the intended use of the modular tower 10, wind on the TV antenna may produce torsional forces. The bolt 65 secures the mast 12 to the mast support tube 64 to resist such forces.

In the preferred embodiment illustrated in FIG. 1, the mast support brace assembly 42 functions the same as the aforedescribed junction brace assembly 43 as it joins columns 20–22 to columns 23–25.

Figure 7:
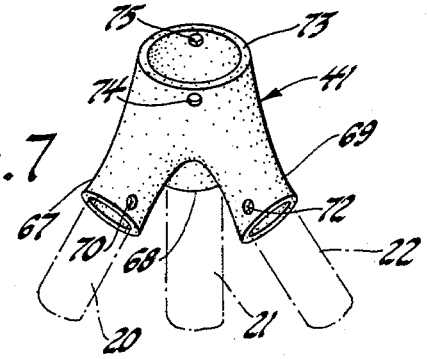
FIG. 7 is a perspective view of a mast guide brace assembly shown in FIG. 1.

As shown in FIG. 7, the mast guide brace assembly 41 includes three tubular legs 67–69 into which the columns 20–22 are inserted. Each of the legs 67–69 contain holes 70–72, two of which are illustrated, through which a bolt may be inserted to secure the columns 20–22 to the mast guide brace assembly 41 by means of suitable bolts. The mast guide brace assembly 41 includes a mast support guide hole 73 through which the mast 12 is inserted. Holes 74 and 75 are provided in the mast guide brace assembly 41 to align with corresponding holes in mast 12 to secure the mast 12 by means of a bolt to the mast guide assembly 41, which helps resist torsional forces in the mast 12.

Figure 8:
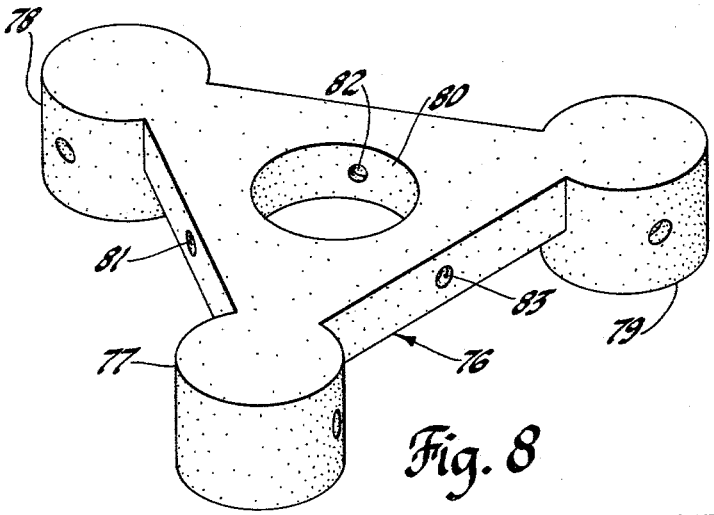
FIG. 8 is a perspective view of an alternate embodiment mast brace guide assembly.

In FIG. 8 an alternative mast guide brace assembly 76 is illustrated which may be used in place of the mast guide brace assembly 41. The mast guide brace assembly 76 includes covered tubes 77–79, a mast support guide hole 80 and threaded holes 81–83 in which suitable bolts can be positioned to restrain the mast 12 against torsional forces when it is inserted through the mast support guide hole 80.

Figure 9:
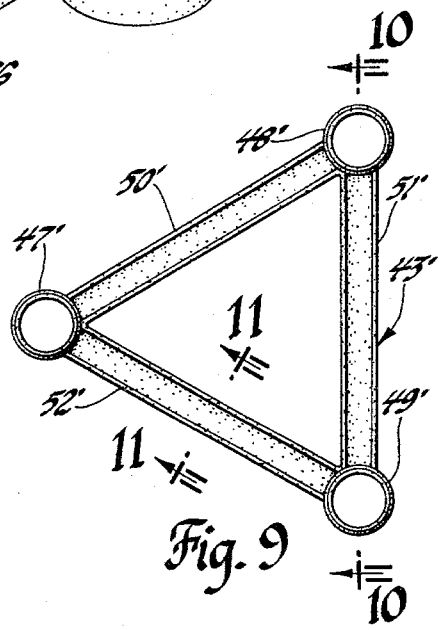
FIG. 9 is a perspective view of an alternate embodiment junction brace assembly.

In FIG. 9 an alternative embodiment of the junction brace assembly 43 is illustrated. FIG. 9 illustrates a junction brace assembly 43' containing tubes 47'–49' connected by support members 50'–52'.

Figure 10:
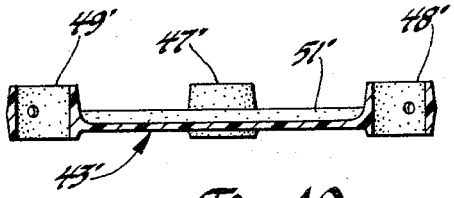
FIG. 10 is a sectional view taken on line 10—10 of the junction brace assembly in FIG. 9.
Figure 11:
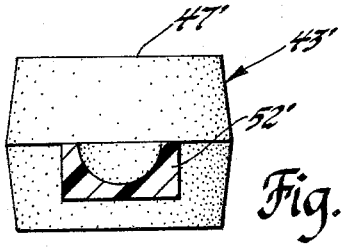
FIG. 11 is a sectional view taken on line 11—11 of the junction brace assembly in FIG. 9.

As shown in FIGS. 10 and 11, the support members 50'–52' in the illustrated alternative embodiment have a hollow cross section. The tubes 47'–49' in the illustrated alternative embodiment also are tapered on the outside surface. The junction brace assembly 43' functions in the manner as the junction brace assembly 43 and hence needs no further description.

Persons versed in the art will appreciate that various modifications may be made on the structures indicated in the attached drawings without departing from the spirit of this invention. For example, the tubular columns 20–37 need not be tubular through their entire length. For example, columns 20–37 may be made from an extruded plastic which has been hollowed at one end and ground at the other end to fit together in the manner described herein and as illustrated in FIG. 5.

Persons versed in the art will also appreciate that the columns 20–37 need not be connected by inserting the lower column into the column above as the subject modular tower 10 could be put together by having a crimped section on the bottom of an upper column and inserting the upper column into a lower column. Such modification would be the same as if the apparatus in FIG. 5 were inverted. The crimped and hollow sections could also be tapered.

Persons versed in the art will also appreciate that even though the connecting apparatus for connecting the various brace assemblies to the columns 20–37 are illustrated as being a nut and bolt, other suitable connecting apparatus could be used without departing from the spirit of this invention.

Persons versed in the art will also appreciate that even though the masts 20–22 in the illustrated embodiment of FIG. 1 are slightly curved for insertion in the mast guide brace assembly 41, the use of a mast guide brace assembly 76 would necessitate that the columns 20–22 were straight. Accordingly, for purposes of this specification and the appended claims, the columns 20–22 in the mast support section 14 of the tower 10 are considered to be substantially vertical regardless of the particular embodiment under consideration.

Persons versed in the art will also appreciate that the cross section configuration of the columns 20–37 is not critical to the subject invention. While in the preferred embodiment tubular columns 20–37 have been illustrated persons versed in the art will appreciate that the columns 20–37 could have any suitable cross section. By way of example, the columns 20–37 could be in the form of triangular columns or square columns. Obviously if the columns 20–37 were not cylindrical, the tubes 47–49 in the mast guide brace assemblies 43 and the other brace assemblys would have to have a corresponding cross section to accommodate the insertion therein of columns 20–37 having cross sections other than circular. Accordingly, for purposes of the specification and the appended claims where the dimensions of the columns 20–37 and tubes illustrated as surrounding same are mentioned as diameters it will be understood that for configuration other than cylindrical columns the term diameter will apply to the corresponding dimension of the particular configuration under consideration.

Persons versed in the art will appreciate that even though reference has been made in this specification to having a crimped section 59 on the upper end of column 28 and a corresponding crimped section on the other columns this terminology is in reference to the particular configuration illustrated and is not intended to mean a particular means of manufacturing a narrowed section at the end of a column. Persons versed in the art will appreciate that a narrowed section can be produced by many means, including crimping and swaging manufacturing processes, without departing from the spirit of this invention.

As shown in FIG. 1, each of the columns 20–37 in the illustrated embodiment is provided with a hole in the middle of the column 20–37. The holes illustrated are numbered 84–95. These holes are provided so that in the event it is desired to add additional brace assemblies other than those illustrated such brace assemblies may be added by simply placing the brace assembly at the point where said holes exist in the columns 20–37 and bolting the additional brace assemblies to the holes. For example, in the event it is desired to insert a greater length of the mast 12 inside the tower 10, the columns 20–22 may be securely fastened to the columns 23–25 by using a junction brace assembly similar to junction brace assembly 43 at the point where columns 20–22 join columns 23–25. The mast support brace assembly 42 in that event could be secured at the location illustrated by the holes 85 and 91, in which event the mast 12 would extend through the center of the junction brace assembly which fastens columns 20–22 to columns 23–25. In the alternative, a mast guide brace assembly similar to mast guide brace assembly 76 could be used to join columns 20–22 to columns 23–25 provided the tubes 77–79 were open at both ends. Using the mast guide brace assembly 76 in this position would provide additional torsional force resistance in the mast 12.

Brace assemblies could be added at various other locations in the tower 10 by simply bolting the brace assemblies to the tower 10 columns where desired. Such additional brace assemblies may be desired for adding additional steps in climbing the tower 10 or in the event the tower 10 were to be used in a situation requiring additional rigidity over that provided by the brace assemblies joining the various columns.

Now that the apparatus in the illustrated drawings has been described, it is apparent that I have provided a method for a single individual to construct a modular tower. To construct the tower as indicated the individual would first secure base section 19 to the rigid support surface represented by the ground 40 by pouring the concrete 38 in the hole 39 and setting the columns 35–37 in the concrete. Said columns 35–37 are positioned in a substantially vertical position. The workman then stacks tower section 18 on tower section 19 by placing columns 32–24 on the crimped section of columns 35–37 to abut the shoulder in columns 35–37. The workman then braces the columns 32–37 by positioning junction brace assembly 46 over columns 32–37 so the vertical tubes of the junction brace assembly 46 each substantially encircle said columns and a rigid support member in said junction brace assembly 46 connects said tubes. The workman then fastens each of said columns rigidly to said junction brace assembly 46 by bolting the junction brace assembly 46 to the columns 32–37 so as to rigidly connect section 18 to section 19. The workman repeats the steps aforedescribed by adding successive tower sections 17, 16, 15, and 14 and concludes the erection of the tower by fastening the mast support brace assembly 42 at a selected point, attaching the mast guide brace assembly 41, inserting the mast 12 through the mast guide brace assembly 41 until it is supported by the mast support brace assembly 42, and securing the mast to the mast support brace assembly 42 and to the mast guide brace assembly 41.

Persons versed in the art will appreciate that various modifications may be made to the method and apparatus described herein without departing from the spirit of the invention.

What is claimed is:

1. A modular tower comprising, in combination, substantially identical first and second tower sections, each tower section including at least two substantially identical parallel vertical columns, each of said columns having a hollow first end defined by an inside and outside diameter and a second end defined both by an outside diameter that is slightly smaller than said first end inside diameter and also by a shoulder, said second column ends in said first section being inserted in said first column ends in said second section until each of said first column ends abuts said shoulder on one of said second column ends; a brace assembly for connecting said sections, said brace assembly including a plurality of tubes and a plurality of support members rigidly connecting said tubes, each of said tubes being defined by a vertical axis and an inside diameter slightly larger than the outside diameter of said first column end, said brace assembly being positioned so that each of said tubes substantially surrounds one of said first column ends in said first section at a point where one of said second column ends is inserted in said one first column end; and connecting means for rigidly securing said brace assembly to each of said first and second column ends at a point where said first and second column ends are surrounded by tubes in said brace assembly so as to fasten each of said tubes to first and second column ends in said tubes whereby one of said sections is supported on the other of said sections.

2. A modular tower comprising, in combination, a base section for supporting said tower, a tower section supported by said base section, said base and tower sections each including at least two substantially vertical columns, said vertical columns in said tower section each being axially aligned with and positioned on one of said columns in said base section, said columns in one of said sections having a hollow column end in which one column end in the other of said sections is inserted, said hollow column end having an inside diameter and said one column end having an outside diameter slightly smaller than said inside diameter; a brace assembly having at least two vertical tubes, each of said tubes being positioned to encircle one of said hollow column ends at a point where said one column end of a column in said other section is inserted, and rigid support members rigidly connecting said tubes; and fastening means for rigidly connecting each one of said tubes both to said hollow column end and to said one column end inserted in said hollow column end at a point where both of said column ends are encircled by said tube so as to rigidly fasten said columns in said base section to said columns in said tower section.

3. A modular tower comprising, in combination, a base section having at least two tubular vertical columns each having a predetermined inside and outside diameter and first and second column ends, each of said columns having a crimped section in one of said ends with a certain outside diameter, a hollow column end having an inside diameter greater than said certain outside diameter, and a load bearing shoulder adjacent said crimped section; a mast support section having at least two substantially vertical columns having upper and lower ends substantially the same as the ends of said base section columns, said lower ends of said mast support section columns each being adapted to be joined with one of said base section columns by inserting said crimped section of one column end into another column hollow end whereby each of said mast support section columns are each supported by said shoulder on one of said columns; a junction brace assembly having at least two vertical sleeves that each have an inside diameter greater than said outside diameter of said hollow ends and a connecting frame rigidly connecting said sleeves whereby each of said sleeves may be positioned around each of said hollow ends when said columns are joined; and connecting means for rigidly securing each of said sleeves to said hollow column ends at a point where one of said crimped sections is inserted in said hollow column ends.

4. A modular tower for supporting a mast comprising, in combination, a mast support tower section comprising three tubular substantially vertical columns, each of said mast support tower section columns including an upper end and a lower end; a top brace having a mast guide hole therein rigidly fastened to each of said upper ends of said mast support tower section columns, said mast guide hole being of a diameter and having an axis direction suitable for axial insertion of said mast through said mast guide hole; at least one base tower section comprising three tubular substantially vertical columns, each of said base tower section columns including an upper and a lower end, each of said mast support and base tower sections being positioned end to end so as to axially align said columns in each of said tower sections with said columns in adjoining tower sections, one end of one of said columns at each junction between said sections being crimped so as to be defined by a shoulder and an outside diameter slightly smaller than the inside diameter of the column adjacent said one end, said one end being inserted in said adjacent column so that said shoulder abuts said adjacent column; a mast support brace assembly for supporting said mast in said mast guide hole, said mast support brace assembly including three tubes which each substantially encircle one of said columns in one of said tower sections at a point where a crimped column end is inserted in the encircled column end, support means for rigidly connecting said mast support brace tubes, and connecting means for rigidly connecting said mast support brace tubes to said mast, to each of said columns encircled by said mast support brace tubes, and to the crimped column ends inserted in said encircled columns; at least one junction brace assembly, each of said jucntion brace assemblies including at least three junction brace tubes each of which substantially encircle one of said columns in one of said tower sections at a point where a crimped column end is inserted in the column encircled by one of said junction brace tubes, and support means which rigidly connect said junction brace tubes, one of said junction brace assemblies being positioned at each of said junctions between said tower sections so that each column in which one of said crimped column ends is inserted is substantially encircled around said crimped column section by one of said junction brace tubes; and connecting means for rigidly connecting each of said junction brace tubes to said columns and to said crimped column ends inserted in said junction brace tubes.

5. The method of erecting a modular tower comprising the steps of securing a base tower section having at least two vertical columns to a rigid support surface so that each of said base section columns is substantially vertical; stacking a second tower section having vertical columns on the top of said base tower section columns, said second tower section having the same number of vertical columns as the number of columns as in said base tower section, each of said second tower section columns and said base tower section columns being adapted for stacking by said columns in one tower section having a crimped end defining a shoulder and said columns in an adjacent tower section having a hollow end for receiving said crimped end so as to abut said shoulder; bracing said vertical columns in adjoining tower sections by positioning a junction brace assembly having vertical tubes which each substantially encircle one of said columns at a point where said crimped end is inserted in a hollow end of an adjacent column, said junction brace assembly also having rigid support members connecting said tubes; and fastening each of said columns from each tower section rigidly to said junction brace assembly at the point where said crimped end is inserted into a hollow end of an abutting column so as to rigidly connect said base tower section to said second tower section.

6. A modular tower for supporting an elongated mast comprising, in combination, a base tower section comprising three substantially vertical columns, a mast support tower section comprising three substantially vertical columns, each of said mass support tower section columns being stacked on top of a base tower section column, each of said columns being defined by hollow and crimped ends, said crimped ends having a shoulder and a certain outside diameter, said hollow ends having an inside diameter larger than said crimped end outside diameter, and an outside diameter whereby each crimped section may be inserted in each hollow end, said mast support tower section being stacked on said base tower section by said crimped column ends in one tower section being inserted in said hollow column ends in the other section; a mast guide assembly rigidly connecting the top ends of said mast support section columns, said mast guide assembly including means for holding said mast in a predetermined position; a mast support assembly for supporting said mast in said predetermined position, said mast support assembly including three vertical tubes which each encircle one of said hollow ends in which a crimped end is inserted; and fastening means rigidly connecting one of said tubes both to the crimped and hollow ends in said tube.

* * * * *